United States Patent [19]

Tennefoss

[11] Patent Number: 5,057,818

[45] Date of Patent: Oct. 15, 1991

[54] SECURITY MAP DISPLAY AND ALARM MONITOR

[75] Inventor: Michael R. Tennefoss, San Francisco, Calif.

[73] Assignee: Stellar Systems Incorporated, Santa Clara, Calif.

[21] Appl. No.: 693,084

[22] Filed: Apr. 29, 1991

[51] Int. Cl.[5] ..... G08B 25/00

[52] U.S. Cl. ..... 340/525; 340/286.11; 340/286.14; 340/815.06; 340/815.12

[58] Field of Search ..... 340/525, 524, 286.14, 340/286.11, 815.06, 815.14, 815.15, 815.12, 990, 995

[56] References Cited

U.S. PATENT DOCUMENTS

| | | | |
|---|---|---|---|
| 3,573,792 | 4/1971 | Reed | 340/815.12 |
| 3,624,648 | 11/1971 | Willoughby | 340/815.06 |
| 3,754,245 | 8/1973 | Peprnik | 340/815.12 |
| 4,011,560 | 3/1977 | Mason et al. | 340/815.12 |

OTHER PUBLICATIONS

"Multi-Zone Graphic Annunciators" by Flair Electronics, Inc. 4-29-91.

"Perimeter Surveillance and Detection" by Computing Devices Company 4-29-91.

"Room With a VU-Data VU Status Display Systems" by RMS Electronic Systems, Inc. 4-29-91.

"Senstar 100 User Guide" by Senstar Corporation, First Edition, Sep. 1, 1988.

"The Versa-Lite Visual Status Graphic Display System" by Versa-Lite Systems, Inc. 4-29-91.

"Vindicator Multiplex Supervisory Systems" by Vindicator 4-29-91.

*Primary Examiner*—Donnie L. Crosland

*Attorney, Agent, or Firm*—Limbach, Limbach & Sutton

[57] ABSTRACT

A security map display and alarm monitor is disclosed that is configured by inserting a site map and drawing lines from security devices or zones shown on the map to indicator clusters located around the border of the map. The indicator clusters indicate the status of the security devices and allow the operator to respond to alarms and change the status of the security devices.

10 Claims, 2 Drawing Sheets

SECURITY MAP DISPLAY AND ALARM MONITOR

This is a continuation of co-pending application Ser. No. 07/481,459 filed on Feb. 15, 1990 now abandoned.

BACKGROUND OF THE INVENTION

1. Field of the Invention

This invention relates generally to security monitoring systems, and relates more particularly to a security map display and alarm monitor that is easily configured by inserting a site map and drawing lines from security devices or zones shown on the map to indicator clusters located around the border of the map.

2. Description of the Relevant Art

A security system typically consists of several sensors or other security devices deployed throughout a site and wired or otherwise connected to a control system. Security devices are available that react to various stimuli, such as sound, vibration, light, heat, smoke, or movement. The security devices might be designed to react to various events, such as opening a door, the presence of a person, the presence of a fire, failure of equipment, or tampering with the security device. Each security device may be said to be associated with a zone or physical space.

In its simplest form, the control system would indicate the status of the security devices. The device that indicates the status of the security devices is known by various names, such as annunciator or annunciator panel, status display, display control panel, monitoring panel, etc. These indicating devices will be referred to below as alarm monitors.

Typically, an alarm monitor would allow some or all of the security devices to be de-activated so that normal activity during certain hours would not cause an alarm. When the security devices are activated, the alarm monitor would typically indicate whether each security device is secured (normal) or alarmed (abnormal). When a security device indicates an alarm, the alarm monitor would announce the alarm by sounding a buzzer, ringing a bell, flashing a light, or some other means.

It is desirable for the alarm monitor to indicate the status of every security device, so that security personnel can determine which location to investigate if an alarm is sounded. Some alarm monitors do this by a bank of indicator lights, with each group or cluster of lights corresponding to one security device. A label next to each cluster of lights, or a separate index, would provide a description of the corresponding security device. A disadvantage to this approach is that the security personnel must either be familiar with the security system or read and understand the label or index before understanding the location of the alarm. Reading the label or index may be difficult in low-light situations or due to language problems. This may be a serious disadvantage where response time is critical.

Alternatively, the alarm monitor might display a map of the site with indicator lights positioned on the map at the location of each security device. Such an alarm monitor would include a custom-made map display panel for the site, displaying the site map and illustrating the locations of the security devices deployed throughout the site. This approach overcomes the disadvantage noted above, but is difficult to set up because a custom-built display panel, with its unique map and indicator light locations, is needed for each individual site. The need for a custom-built display panel limits the use of this type of alarm monitor in situations where rapid deployment is a requirement.

It is also desirable for an alarm monitor to allow security personnel to respond to the status displays of the security devices. For example, the operator should be able to acknowledge an alarm so that the alarm annunciator can be turned off by the security system. Once an alarm is acknowledged and investigated, the operator should be able to reset the display so that the next alarm will be indicated. It is common to provide switches for this purpose, one per security device, located either in a bank with the indicator lights or on the custom-built display panel at the map location of the security devices. Once again, each approach has the same drawbacks noted above. Grouping the switches together does not clearly associate each switch with its corresponding security device, while displaying the switches on the site map requires a custom-made panel.

SUMMARY OF THE INVENTION

In accordance with the illustrated preferred embodiment, the present invention is an alarm monitor that displays a site map showing security devices deployed throughout a site and indicates the status of the security devices. The alarm monitor includes a housing, a map display panel with a transparent cover panel behind which the site map is installed, and multiple indicator clusters mounted to the housing around the periphery of the map display panel. Each indicator cluster includes indicator lights, which indicate the status of a corresponding security device, and a switch, which allows the operator to respond to and change the status of the security device. In order to visually associate the indicator clusters with their corresponding security devices, connecting lines are drawn on either the map or the transparent cover panel between the map location of each security device and the periphery of the map display panel adjacent to the corresponding indicator cluster.

To commission a security system using the present invention, one deploys security devices throughout an area to be secured, connects the security devices to the back of the alarm monitor, installs a site map into the map display panel, and draws connecting lines on either the map or the transparent cover panel from the map location of each security device to its corresponding indicator cluster. A conventional monitoring circuit, packaged within the alarm monitor, monitors the security devices and displays the appropriate status via the indicator lights. The switch in each indicator cluster allows an operator to acknowledge alarms and to direct the monitoring circuit to change the status of the corresponding security device.

A key feature of the present invention is that it can easily be configured to a security site, which allows a security system to be rapidly deployed. No advanced knowledge of the secured site or placement of the security devices is required. The site map can be as crude as a hand drawn sketch on a scrap of paper. The connecting lines can be rapidly hand drawn on the face of the cover panel. If security devices are added, deleted, or relocated, the map and cover panel can be marked accordingly. If information about the security site and deployment of the security devices is available in advance, then a map can be prepared ahead of time, with the connecting lines printed on the map itself.

Another key feature of the present invention is that it visually displays the locations of the security devices, while clearly indicating which indicator cluster is associated with which security device. The operator need not interpret a label or index in order to understand which security device is alarmed. All the operator has to do is follow the connecting line from the indicator cluster to the security device on the site map. This visual association has great advantages in low light situations or when the operators may not be able to reliably or quickly interpret a label or index.

The features and advantages described in the specification are not all inclusive, and particularly, many additional features and advantages will be apparent to one of ordinary skill in the art in view of the drawings, specification and claims hereof. Moreover, it should be noted that the language used in the specification has been principally selected for readability and instructional purposes, and may not have been selected to delineate or circumscribe the inventive subject matter, resort to the claims being necessary to determine such inventive subject matter. For example, the word "map" is used to mean a visual representation of an area, and includes diagrams and drawings. The word "draw" or "drawn" in relation to the connecting lines drawn between a security device shown on the map and its associated indicator cluster, means to delineate by making lines on a surface, including hand-drawing, printing, screening, engraving, etc.

DETAILED DESCRIPTION OF THE PREFERRED EMBODIMENT

Figure 1:
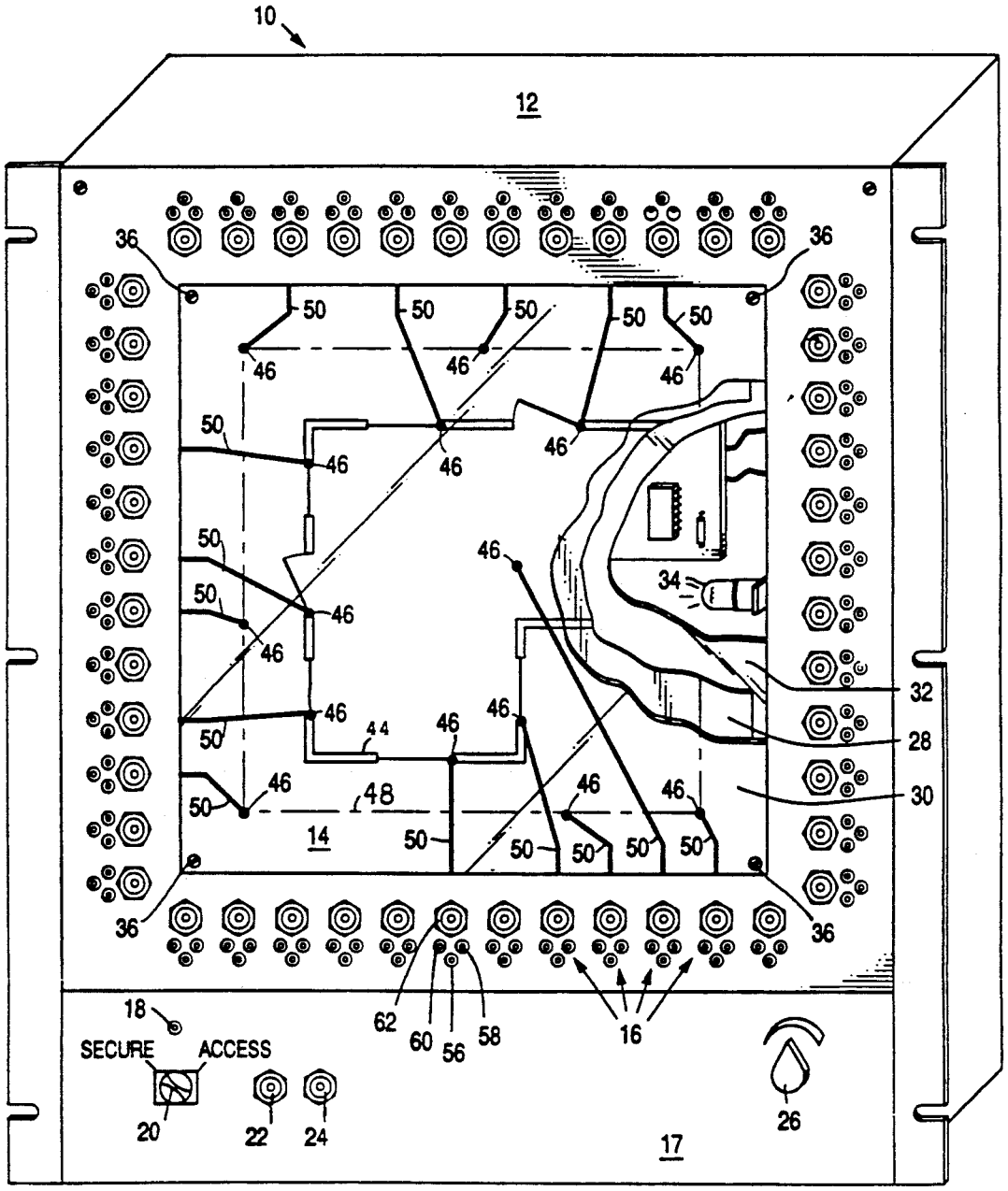
FIG. 1 is a perspective view of the front of an alarm monitor according to the present invention.
Figures 2, 3:
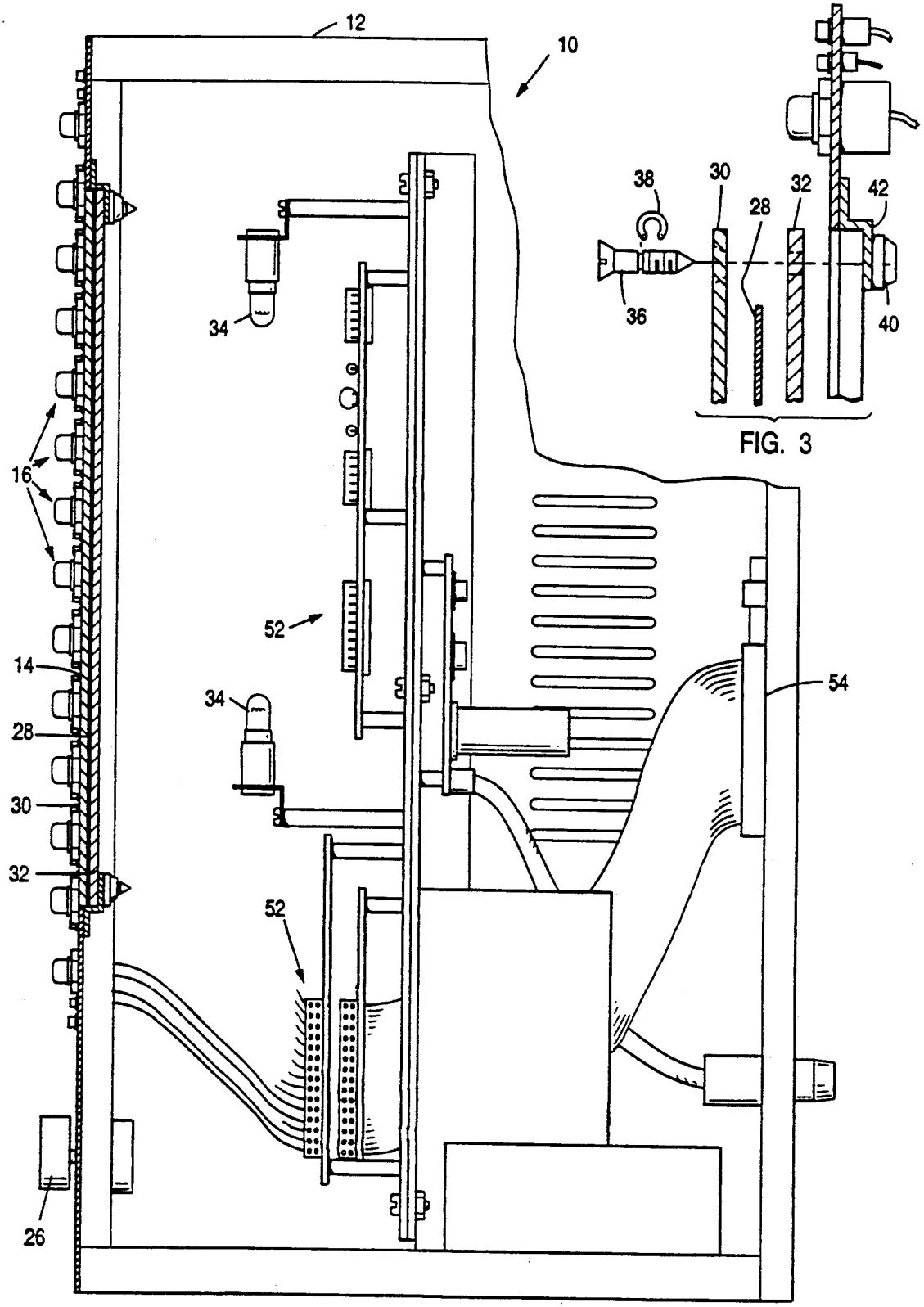
FIG. 2 is a side-elevation sectional view of the alarm monitor of FIG. 1.
FIG. 3 is an exploded detail view of the attachment of a cover panel of the alarm monitor of FIGS. 1 and 2.

FIGS. 1 through 3 of the drawings depict a preferred embodiment of the present invention for purposes of illustration only. One skilled in the art will readily recognize from the following discussion that alternative embodiments of the structures and methods illustrated herein may be employed without departing from the principles of the invention described herein.

The preferred embodiment of the present invention, a security map display and alarm monitor 10, is shown in FIGS. 1–3. The alarm monitor 10 includes a housing 12 with provisions for rack mounting. On the front face of the housing 12 is a map display panel 14 and forty-eight indicator clusters 16 arranged around the outer periphery of the map display panel. At the bottom of the front face of the housing 12 is a control panel 17 that includes a power indicator light 18, a secure/access switch 20, a system test switch 22, and a secure all switch 24. Also at the bottom of the front face of the housing is a backlighting switch 26.

The map display panel 14 contains a map 28 sandwiched between two plexiglass panels 30 and 32. The outer panel 30 is transparent, while the inner panel 32 is translucent. Lights 34 located within the housing 12 behind the map display panel 14 provides illumination for the map 28 under low-light conditions. The backlighting switch 26 is a rheostat that is wired in series with the lights 34 and serves to control the brightness of the lights.

The map display panel 14 is removeably mounted to the housing 12 with four captive screws 36. As shown in FIG. 3, each screw 36 is retained with the panels 30 and 32 by a retaining ring 38, with the screw head accessible from the outside. The retaining ring 38 is installed in a groove in the screw 36 after it is inserted through the panels 30 and 32. The screw 36 threads into a captive nut 40 that is mounted on a flange 42 that in turn is mounted to the inside of the front face of the housing 12. The map 28 can be installed by loosening the captive screws 36, removing the panels 30 and 32 from the housing, inserting the map between the two panels, and refastening the panels to the housing.

The map 28 illustrates the site and the security devices deployed throughout the site. For example, map 28 shows a building 44 with several security devices 46 located throughout the building. The map 28 also shows a perimeter fence 48 also with several security devices 46. A connecting line 50 is drawn between each security device 46 and its associated indicator cluster 16 to provide a visual indication of which security device is associated with which indicator cluster. The connecting lines 50 may be drawn on either side of the outer panel 30, or may be drawn on the map itself. In the illustrated example, there are fewer security devices than indicator clusters, so not all of the indicator clusters are associated with a security device.

Electrical circuitry 52 for monitoring the security devices is packaged within the housing 12. Each of the indicator clusters 16 is wired to the monitoring circuit. Each of the security devices is wired or otherwise connected to the monitoring circuit. Connectors 54 are provided on the back of the housing 12 for connecting the security devices. The connectors 54 are marked with labels to indicate the associated indicator clusters. Other peripherals, not relevant to the present invention, can also be connected to the monitoring circuit, such as a computer, printer, and communication devices. The illustrated alarm monitor 10 can accommodate up to forty-eight security devices, one for each indicator cluster 16.

The monitoring circuit functions in a conventional way to monitor the status of each security device and to illuminate appropriate indicator lights at the associated indicator cluster. Each indicator cluster 16 has three indicator lights or light-emitting diodes, green 56, yellow 58, and red 60, and a cluster switch 62. The cluster switch 62 is a push-button switch that makes contact when pressed.

Under normal conditions, all security devices are secured. When a security device is secured, the green light 56 is steadily illuminated by the monitoring circuit 52.

If an alarm condition is indicated by the security device, the monitoring circuit turns off the green light 56 and flashes the red light 60. The monitoring circuit may also sound a audible alarm. The red light 60 continues to flash until security personnel acknowledges the alarm by pushing the cluster switch 62, at which time the monitoring circuit steadily illuminates only the red light 60. In the course of acknowledging the alarm, the security personnel can determine which security device caused the alarm by tracing the connecting line 50 from the flashing indicator cluster back to a security device marked on the map. This tells the security personnel which location to investigate for the cause of the alarm.

Security personnel can access a zone protected by a security device by changing the status of that security device to accessed. This can be accomplished by turning the secure/access switch 20 to the access position and pressing the appropriate cluster switch 62. When this is done, the yellow access light 58 is steadily illuminated. The secure/access switch 20 is preferably spring loaded to the secure position so that the security personnel must perform a two-step operation each time a security device is accessed.

To change the status of a security device to secure, the cluster switch 62 and secure/access switch 20 are used once again. If the red alarm light is flashing, the alarm must first be acknowledged by pressing the cluster switch. Then, the security device must be accessed by pushing the cluster switch while turning the secure/access switch. This action causes the monitoring circuit to illuminate the yellow access light 58 alone. Then, the security device is secured by once more pushing the cluster switch while turning the secure/access switch. Alternatively, after the alarm has been acknowledged, the operator can once again push the cluster switch 20 to secure the device. The monitoring circuit illuminates the green secured light 56 to indicate that the security device has been secured.

From the above description, it will be apparent that the invention disclosed herein provides a novel and advantageous apparatus for a security map display and alarm monitor. The foregoing discussion discloses and describes merely exemplary methods and embodiments of the present invention. As will be understood by those familiar with the art, the invention may be embodied in other specific forms without departing from the spirit or essential characteristics thereof. For example, the connecting lines could be marked on a transparent sheet that is inserted between the map and the outer cover. Accordingly, the disclosure of the present invention is intended to be illustrative, but not limiting, of the scope of the invention, which is set forth in the following claims.

What is claimed is:

1. An alarm monitor for displaying a site map showing placement of security devices throughout a site, said alarm monitor comprising:

a housing;

a map display panel mounted to the housing and including a transparent cover panel behind which a site map can be displayed;

multiple indicator clusters mounted to the housing at the periphery of the map display panel, wherein each indicator cluster may be functionally associated with a security device and includes one or more indicator lights and a switch; and means for visually associating security devices shown on the site map with their associated indicator clusters by connecting lines visible when the site map is displayed in the map display panel, wherein each connecting line extends between the map location of a security device and the periphery of the map display panel adjacent to the associated indicator cluster.

2. An alarm monitor as recited in claim 1 wherein the map display panel includes means for releasably attaching the transparent cover panel to the housing.

3. An alarm monitor as recited in claim 1 wherein the map display panel includes an assembly of two panels and means for releasably attaching the two panels to the housing, wherein the outer of the two panels is the transparent cover panel and wherein a site map is inserted between the two panels for display.

4. An alarm monitor as recited in claim 3 wherein the inner of the two panels is translucent and wherein the alarm monitor further includes one or more lights disposed within the housing behind the map display panel for illuminating an installed map from the backside thereof.

5. An alarm monitor as recited in claim 1 wherein said means for visually associating the security devices with their associated indicator clusters includes connecting lines drawn on the transparent cover panel.

6. An alarm monitor as recited in claim 1 wherein said means for visually associating the security devices with their associated indicator clusters includes connecting lines drawn on the installed map.

7. An alarm monitor for displaying a site map showing placement of security devices throughout a site, said alarm monitor comprising:

a housing;

a map display panel removeably mounted to the housing and including a transparent outer panel and a translucent inner panel, wherein a site map is inserted between the two panels for display;

one or more lights disposed in the housing behind the map display panel for back-lighting a site map installed in the map display panel;

multiple indicator clusters mounted to the housing at the periphery of the map display panel, wherein each indicator cluster may be functionally associated with a security device and includes one or more indicator lights and a switch; and means for visually associating security devices shown on the site map with their associated indicator clusters by connecting lines visible when the site map is displayed in the map display panel, wherein each connecting line extends between the map location of a security device and the periphery of the map display panel adjacent to the associated indicator cluster.

8. An alarm monitor for visually displaying the status of security devices deployed at a site, and for displaying a map of the site illustrating the placement of the security devices, said alarm monitor comprising:

a housing;

a map display panel mounted to the housing and including a transparent cover panel behind which the site map can be inserted for display;

multiple indicator clusters mounted to the housing at the periphery of the map display panel, wherein each indicator cluster includes one or more indicator lights and a switch;

means for functionally associating each security device with an indicator cluster so that the indicator lights indicate the status of the security device and the switch allows an operator response to the status of the security device; and means for visually associating each security device with its functionally associated indicator cluster by a connecting line drawn on either the site map or the transparent cover panel, wherein each connecting line extends between the map location of a security device and the periphery of the map display panel adjacent to the indicator cluster functionally associated with that security device.

9. A method for visually displaying on an alarm monitor the status of security devices deployed at a site, said method comprising:

installing a site map behind a transparent cover panel in a map display panel, wherein the site map illustrates the placement of security devices deployed at the site, and wherein the map display panel is part of the alarm monitor;

electrically coupling each security device to an indicator cluster mounted to the alarm monitor at the periphery of the map display panel, wherein each indicator cluster includes one or more indicator lights that indicate the status of the security device and a cluster switch that permits an operator response to the status of the security device; and drawing connecting lines on either the site map or the transparent cover panel from the map location of each security device to the periphery of the map display panel adjacent to the indicator cluster coupled to that security device.

10. A method as recited in claim 9 wherein each indicator cluster has red, yellow, and green indicator lights for indicating that an associated security device has an alarmed, accessed, or secured status, respectively, wherein the alarm monitor includes a secure/access switch, and wherein the method further comprises the steps of:

indicating the status of the security devices by steadily illuminating the green light at each indicator cluster associated with a secured security device, by steadily illuminating the yellow light at each indicator cluster associated with an accessed security device, and by flashing the red light at each indicator cluster associated with an alarmed security device;

indicating an operator acknowledgement of the alarmed status of a security device by steadily illuminating the red light in the indicator cluster associated with that security device in response to operator activation of the associated cluster switch; and then indicating that the security device has been accessed by steadily illuminating the yellow light in the indicator cluster in response to activating both the secure/access switch and the cluster switch; and then indicating that the security device has been secured by steadily illuminating the green light in the indicator cluster in response to activating both the secure/access switch and the cluster switch.

* * * * *